US010697207B2

(12) United States Patent
Zweibohmer et al.

(10) Patent No.: US 10,697,207 B2
(45) Date of Patent: Jun. 30, 2020

(54) ROTARY LATCH PLATES

(71) Applicant: TriMark Corporation, New Hampton, IA (US)

(72) Inventors: Dennis J. Zweibohmer, Ionia, IA (US); Shayne E. Dodge, New Hampton, IA (US); Tobias J. Schwickerath, New Hampton, IA (US); Gene C. Light, Denver, IA (US); Jason E. Stibs, Marquette Heights, IL (US); Matthew L. Hidding, Elma, IA (US)

(73) Assignee: TriMark Corporation, New Hampton, IA (US)

( * ) Notice: Subject to any disclaimer, the term of this patent is extended or adjusted under 35 U.S.C. 154(b) by 438 days.

(21) Appl. No.: 15/068,221

(22) Filed: Mar. 11, 2016

(65) Prior Publication Data

US 2017/0260777 A1 Sep. 14, 2017

(51) Int. Cl.

| | |
|---|---|
| ***E05B 85/02*** | (2014.01) |
| ***E05B 79/08*** | (2014.01) |
| ***E05B 79/06*** | (2014.01) |
| ***E05B 63/04*** | (2006.01) |
| ***E05B 63/00*** | (2006.01) |
| ***G09F 23/00*** | (2006.01) |

(52) U.S. Cl.

CPC ..... *E05B 79/08* (2013.01); *E05B 63/0056* (2013.01); *E05B 63/042* (2013.01); *E05B 63/044* (2013.01); *E05B 79/06* (2013.01); *E05B 85/02* (2013.01); *G09F 23/00* (2013.01); *Y10S 292/53* (2013.01); *Y10S 292/54* (2013.01)

(58) Field of Classification Search

CPC ..... Y10S 292/53; Y10S 292/54

USPC ..... 292/95, 216

See application file for complete search history.

(56) References Cited

U.S. PATENT DOCUMENTS

| | | | | |
|---|---|---|---|---|
| 295 A | | 7/1837 | Snider | |
| 5,564 A | | 5/1848 | Brewer | |
| 1,470,382 A | * | 10/1923 | Lance | E05D 13/06 292/40 |
| 2,888,288 A | | 5/1959 | Rigaud | |
| 3,014,417 A | | 12/1961 | Maiershofer | |

(Continued)

FOREIGN PATENT DOCUMENTS

| | | | |
|---|---|---|---|
| DE | 202008000560 | U1 | 4/2008 |
| EP | 1039079 | A1 | 9/2000 |

(Continued)

OTHER PUBLICATIONS

13140 NGL Patent Review, 13 pgs. Sep. 19, 2014.

*Primary Examiner* — Carlos Lugo

(74) *Attorney, Agent, or Firm* — McKee, Voorhees & Sease, PLC

(57) ABSTRACT

A rotary latch assembly is provided wherein the front plate has a C-shaped configuration with opposite top and bottom flanges, and an interconnecting front face. A back plate is connected to the front plate for use in right-handed and left-handed applications. One or more trip levers are mounted on the plates to release the catch and rotor from a latched position. An embossment is provided on the front plate to strengthen the assembly and to support the rotor and the catch. Indicia is provided on the latch assembly to provide for ease of alignment with the striker for proper latching.

10 Claims, 6 Drawing Sheets

(56) References Cited

U.S. PATENT DOCUMENTS 4,602,813 A * 7/1986 Gergoe ..... E05B 85/045 292/340
4,703,961 A 11/1987 Weinerman et al.
4,763,934 A 8/1988 Kaveney, Jr.
4,896,906 A 1/1990 Weinerman et al.
4,917,412 A 4/1990 Swan et al.
5,069,491 A 12/1991 Weinerman et al.
5,127,686 A 7/1992 Gleason et al.
5,186,504 A * 2/1993 Takaishi ..... E05B 85/02 292/216
5,299,844 A 4/1994 Gleason
5,316,354 A * 5/1994 Arabia, Jr. ..... E05B 85/045 292/340
5,439,260 A 8/1995 Weinerman et al.
5,564,295 A 10/1996 Weinerman et al.
5,586,458 A 12/1996 Weinerman et al.
5,595,076 A 1/1997 Weinerman et al.
5,611,224 A 3/1997 Weinerman et al.
5,884,948 A 3/1999 Weinerman et al.
6,012,747 A * 1/2000 Takamura ..... B60N 2/366 292/210
6,149,210 A 11/2000 Hunt et al.
6,158,787 A 12/2000 Kutschat
6,419,284 B1 7/2002 Kutschat
6,454,321 B1 9/2002 Parikh
6,471,260 B1 10/2002 Weinerman et al.
6,494,506 B1 12/2002 Gleason et al.
6,497,436 B1 * 12/2002 DeBlock ..... E05B 81/06 292/201
6,651,467 B1 11/2003 Weinerman et al.
6,695,361 B1 2/2004 Gleason et al.
6,942,259 B2 9/2005 Marzolf et al.
6,962,375 B2 11/2005 Linares
7,055,874 B1 6/2006 Jeffries et al.
7,137,656 B2 11/2006 Bird et al.
7,140,649 B1 11/2006 Gregory
7,156,430 B2 1/2007 Hidding et al.
7,267,377 B2 9/2007 Marzolf et al.
7,267,380 B2 9/2007 Bullock et al.
7,309,087 B2 12/2007 Lane et al.
7,320,488 B2 1/2008 Hidding et al.
7,338,097 B2 3/2008 Marzolf et al.
7,497,488 B2 3/2009 Chen
7,513,541 B1 4/2009 Gregory
7,611,173 B2 11/2009 Helton et al.
7,726,707 B2 * 6/2010 Simchayoff ..... E05B 15/022 292/201
7,861,475 B2 * 1/2011 Sprague ..... E04B 2/827 160/196.1
7,938,458 B1 5/2011 Zweibohmer et al.
8,075,027 B2 12/2011 Zweibohmer
8,382,168 B2 2/2013 Carabalona et al.
8,801,052 B2 * 8/2014 Bender ..... E05B 83/16 292/216
8,894,105 B2 11/2014 Kutschat et al.
9,004,550 B2 4/2015 Carabalona et al.
2004/0178643 A1 9/2004 Marzolf et al.
2005/0140146 A1 6/2005 Spurr
2005/0206172 A1 9/2005 Bacon
2006/0006668 A1 1/2006 Ridding et al.
2006/0012184 A1 1/2006 Ottesen et al.
2006/0208505 A1 9/2006 Christoffel et al.
2014/0035293 A1 2/2014 Weinerman et al.

FOREIGN PATENT DOCUMENTS

EP 1357246 A1 10/2003
FR 2937071 A1 10/2008
GB 2447357 B 7/2011
WO 02079598 A2 10/2002

* cited by examiner

ROTARY LATCH PLATES

BACKGROUND OF THE INVENTION

Vehicle door latches, both for the driver and passenger compartments as well as other storage compartments, include latches to secure the door in a closed position. Strength and durability of the latches are usually important features for the long-term life of the latch through repeated use.

Also, versatility of the latch for various applications is a desired feature which minimizes latch variations, inventory, and costs.

Therefore, there is a need for a strong, durable, and versatile latch useful for many applications.

Accordingly, a primary objective of the present invention is the provision of a rotary latch assembly with an improved plate structure having strength, durability and versatility.

Another objective of the present invention is the provision of a rotary latch assembly having a front C-shaped front plate with top and bottom flanges, and to which a back plate can be easily mounted.

A further objective of the present invention is the provision of a rotary latch assembly having a front plate with a strength-enhancing embossment extending beneath the rotor and catch and extending continuously between the opposite ends of the plate.

Still another objective of the present invention is the provision of a rotary latch assembly having multiple points for alternative connections of trip levers for actuating the catch and rotor.

Yet another objective of the present invention is the provision of a rotary latch assembly having modular components that can be assembled for right and left-handed applications.

A further objective of the present invention is the provision of a rotary latch assembly having indicia for aligning the striker to the latch.

Still another objective of the present invention is the provision of a rotary latch assembly having a back plate with hex-shaped holes for mounting the axles for the rotor and the catch.

Another objective of the present invention is the provision of a rotary latch assembly having a back plate with tabs to limit rotation of the trip lever.

A further objective of the present invention is the provision of a rotary latch assembly having a back plate with tabs to retain the ends of springs for the rotor and catch.

Another object of the present invention is the provision of a rotary latch assembly which is economical to manufacture and install, and which is safe and simple to use.

These and other objectives will become apparent from the following description of the invention.

SUMMARY OF THE INVENTION

The rotary latch assembly of the present invention includes a front plate and a back plate which are assembled together with stepped axles to support a rotor and catch in between. The front plate is C-shaped, with opposite top and bottom flanges and a front face. The top flange and front face have a cut-out for receiving a striker. An embossment is provided on the front face beneath the rotor and catch and extending substantially along the length of the latch. The front and back plates are symmetrical about a center line, so as to have opposite mirror image ends, which allows the plates to be assembled in both a right-hand and a left-hand configuration. The plates include multiple connection points for trip levers. One or more trip levers can be connected to the latch assembly for different configurations to serve alternate applications. A mark, hole or other indicia is provided on the latch assembly to facilitate alignment with the striker. The back plate includes a center tab to limit rotation of the trip levers, and opposite end tabs to retain ends of springs for the rotor and the catch.

DETAILED DESCRIPTION OF THE INVENTION

Figure 1:
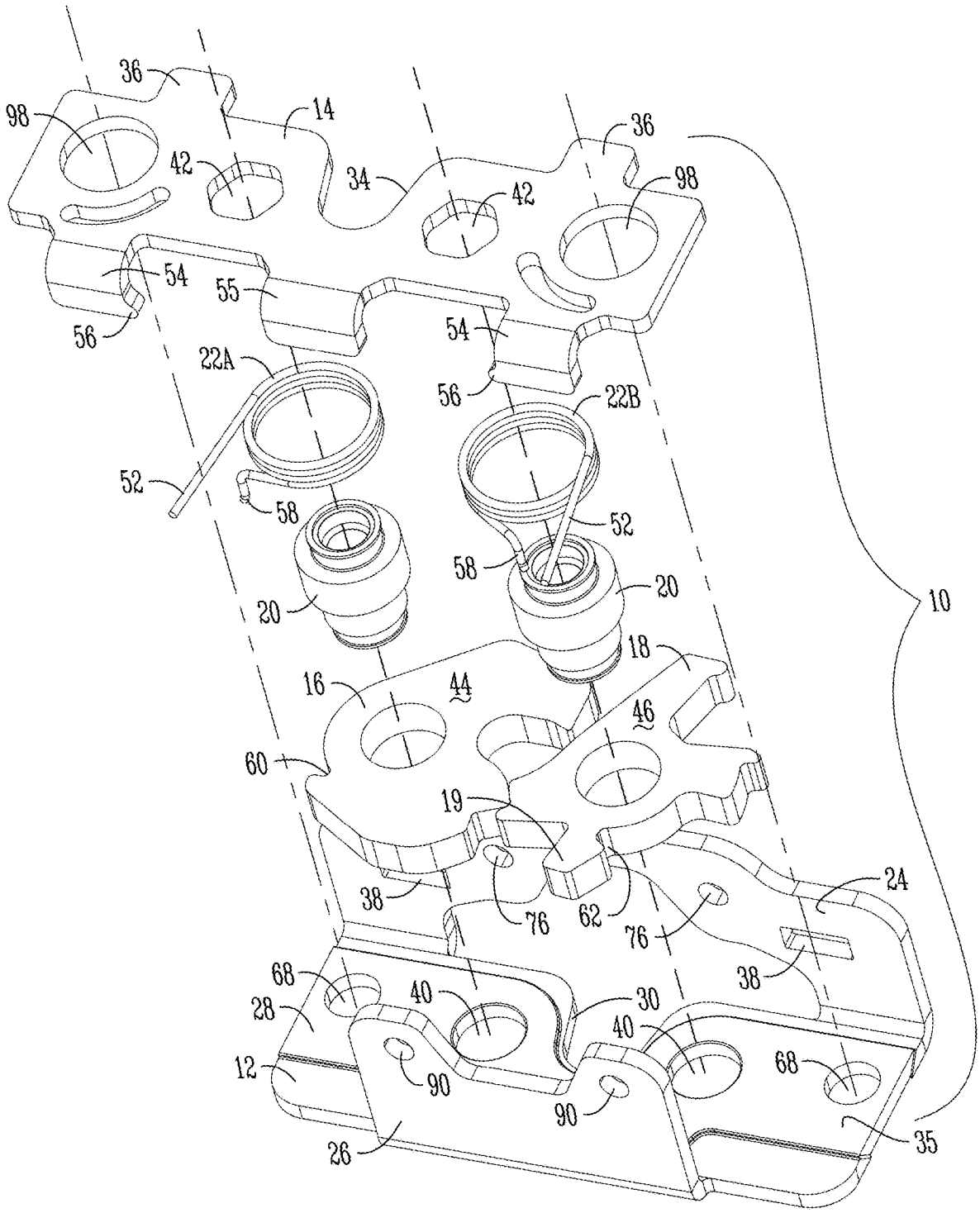
FIG. 1 is an exploded perspective view of the latch assembly of the present invention assembled for a right-handed application.
Figure 2:
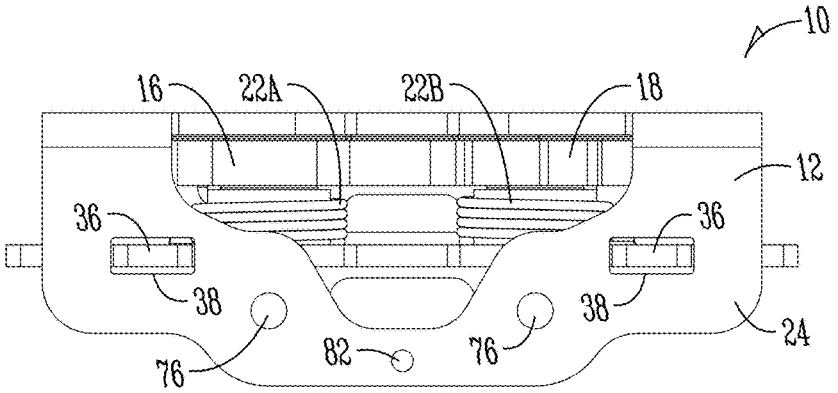
FIG. 2 is a top plan view of the latch assembly shown in FIG. 1.
Figure 3:
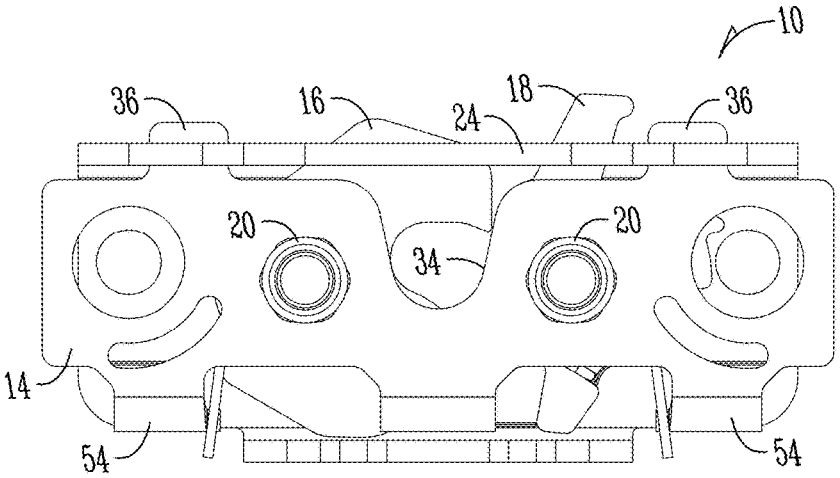
FIG. 3 is front elevation view of the latch assembly shown in FIG. 1, with the rotor and catch in a latched position.
Figure 4:
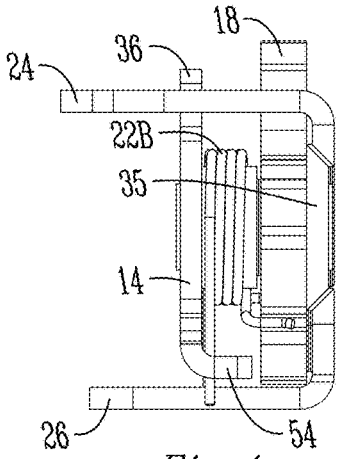
FIG. 4 is a right end view of the latch assembly shown in FIG. 1.
Figure 5:
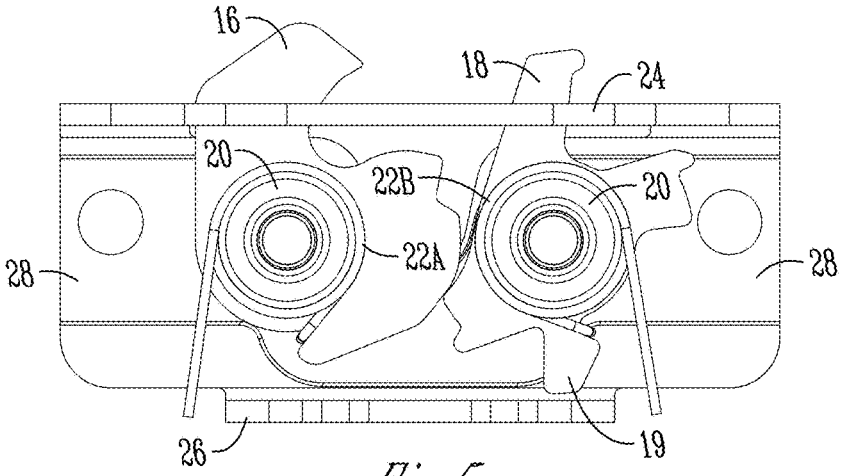
FIG. 5 is a view similar to FIG. 3, with the back plate removed to show the internal components, with the rotor and catch in an unlatched position.

The latch assembly 10 of the present invention includes modular components which allow the latch to be assembled for right-handed applications, as shown in FIGS. 1-5, and for left-handed applications, as shown in FIGS. 6-10. The latch assembly 10 includes only eight primary components for use in the right and left-handed applications. These components include a common front plate 12, a back plate 14, a rotor 16, a catch 18, a pair of identical axles 20, and a pair of mirror image springs 22A and 22B.

The front plate 12 is C-shaped, with a top flange 24, a bottom flange 26, and an interconnecting front face 28. The front plate 12 includes a cut-out 30 for receipt of a striker. The back plate 14 has a similar cut-out or notch 34 for receipt of the striker. An embossment 35 extends continuously along the length of the front face 28. The rib 35 adds strength to the front plate 12 and provides a support surface for the rotor 16 and the catch 18. Since the width of the rib 35 is less than the diameters of the rotor and the catch, contact friction between the rib and the rotor/catch is minimized.

The back plate 14 includes a pair of tabs 36 for receipt in a pair of slots 38 in the inner leg 24 of the front plate 12. This mounting configuration of the back plate 14 to the front plate 12 via the tabs 36 and the slots 38 is the same for both the right-handed and left-handed latch assemblies.

The axles 20 are mounted between the front plate 12 and the back plate 14. The front plate 12 includes a pair of holes 40 for receiving one end of the axles 20, and the back plate 14 includes a pair of holes 42 to receive the opposite end of the axles 20. The holes 42 are hex-shaped to reduce axle spin during mounting. The hex holes 42 let the axles 20 form into the corners of the hex, which allows a greased axle to achieve the desired axle torque resistance after assembly. Thus, the hex holes 42 increase axle torque resistance after the axles are assembled in the front and back plates 12, 14.

Figure 6:
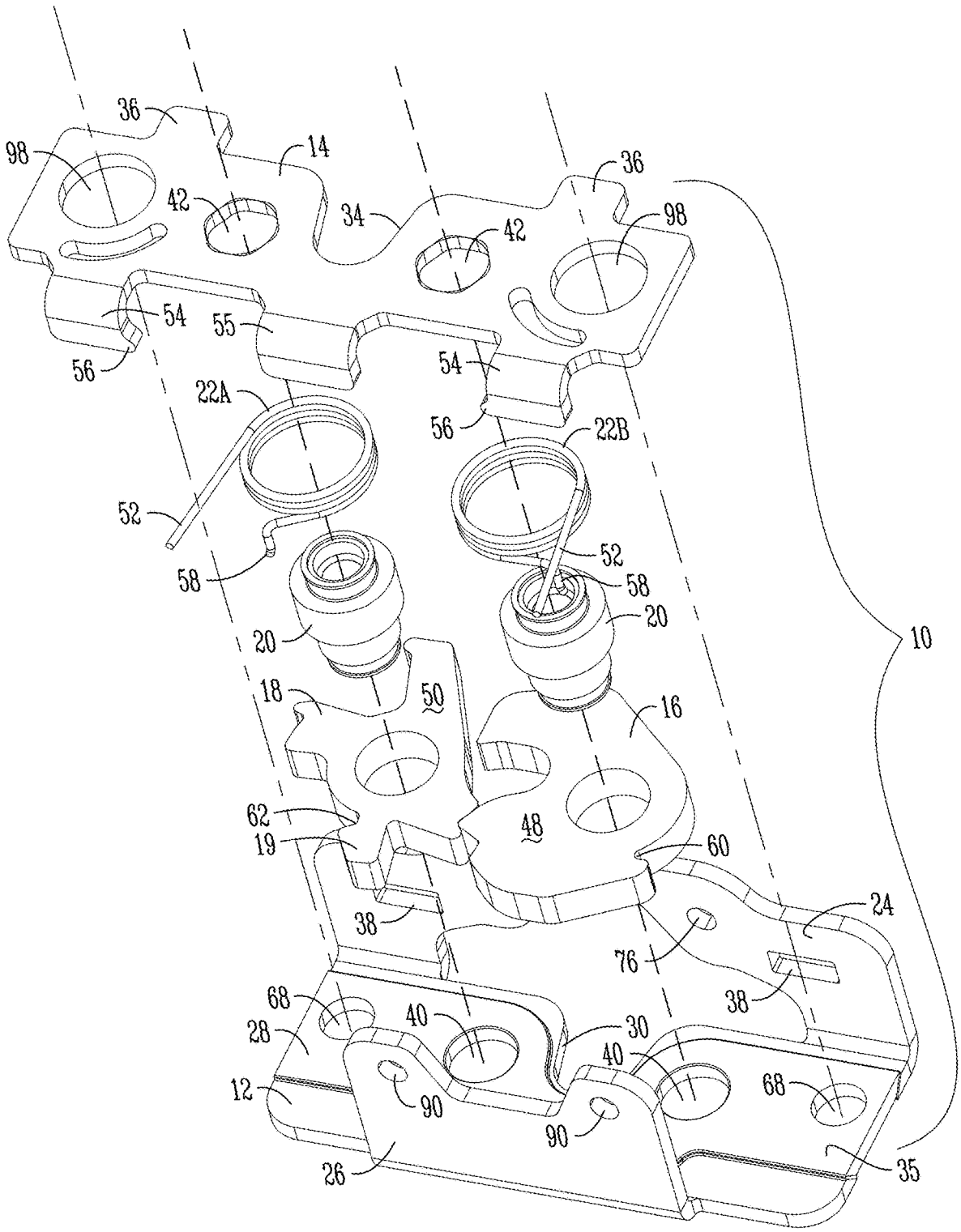
FIG. 6 is an exploded perspective view of the latch assembly, with the components arranged to form a left-handed latch.
Figure 7:
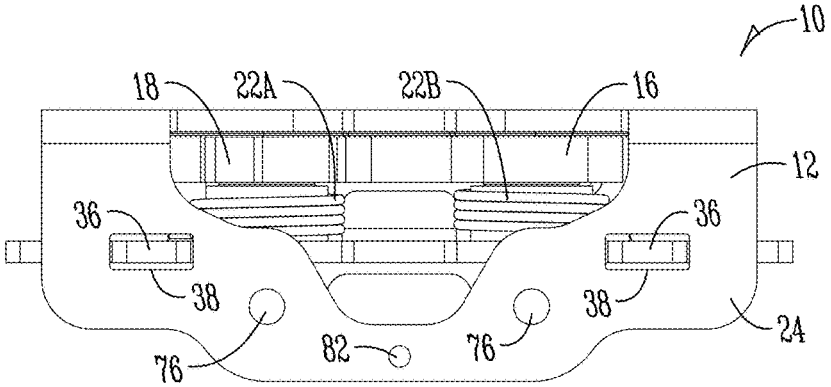
FIG. 7 is a top plan view of the latch assembly shown in FIG. 6.
Figure 8:
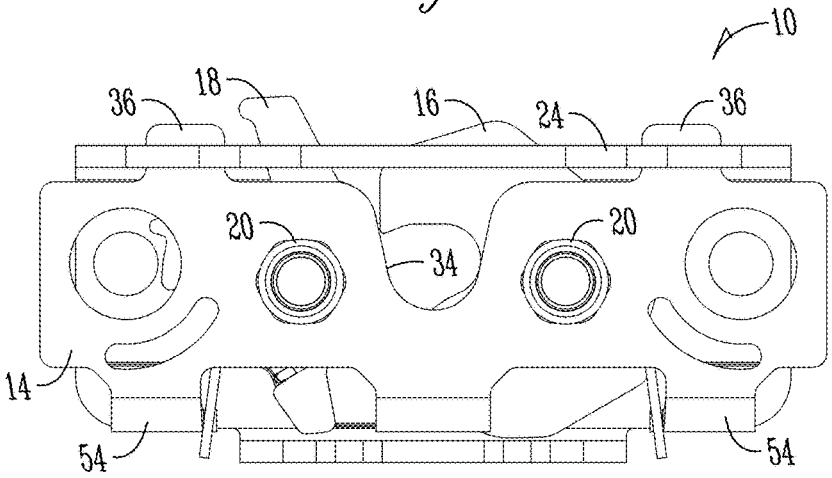
FIG. 8 is front elevation view of the latch assembly shown in FIG. 6, with the rotor and catch in a latched position.
Figure 9:
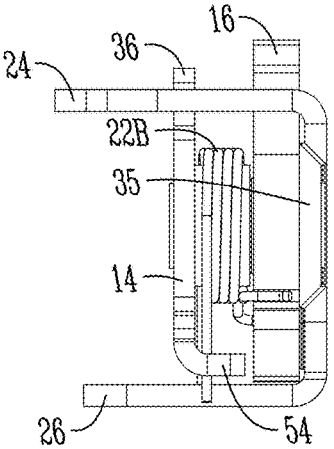
FIG. 9 is a right end view of the latch assembly shown in FIG. 6.
Figure 10:
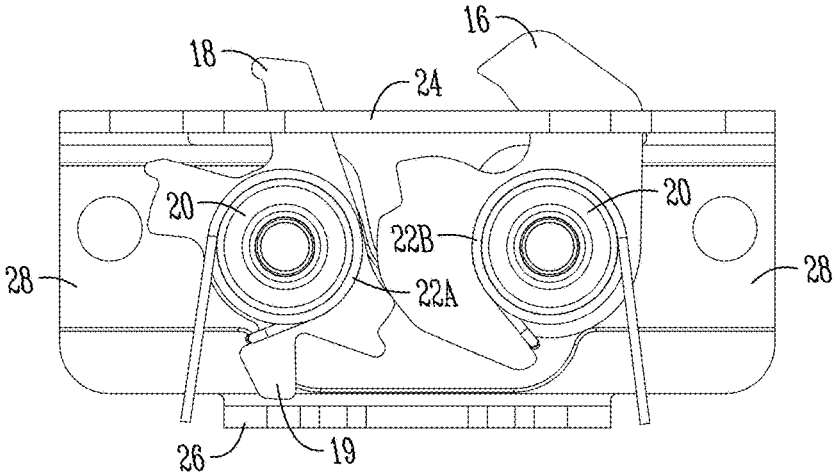
FIG. 10 is a view similar to FIG. 8, with the back plate removed to show the internal components, with the rotor and catch in an unlatched position.

The rotor 16 and the catch 18 are mounted on the axles 20 for rotation about the axle axis between latched and unlatched positions relative to a striker. The rotor 16 and the catch 18 can be exchanged or interchanged on the pair of axles 20 so as to form a right-handed latch, as shown in FIGS. 1-5, or a left-handed latch, as shown in FIGS. 6-10. The rotor 16 and the catch 18 are flipped 180 degrees front to back between the right-hand and left-hand configurations, as best seen in FIGS. 1 and 6. Thus, in a right hand configuration, a first face 44 of the rotor 16 and a first face 46 of the catch face towards the back plate 14. In the left-hand configuration, a second face 48 of the rotor 16 and a second face 50 of the catch 18 face toward the back plate 14.

The springs 22A and 22B are mounted on the axles 20. A first end 52 of each spring 22 is retentively engaged on a pair of outer tabs 54 on the back plate 14. Preferably, each tab 54 has a small hook 56 to facilitate retention of the spring end 52. The second end 58 of each spring 22A and 22B is retentively received in a notch or hook 60 on the rotor 16 and notch 62 on the catch 18. The mirror image configuration of the springs 22A and 22B allow each spring to be used with either the rotor 16 and the catch 18, depending on the right hand and left hand orientation of the rotor and the catch. The springs 22 bias the rotor 16 towards the unlatched position and bias the catch 18 towards the latched position. A center tab 55 on the back plate 14 limits the rotation of a trip lever such as 86 shown in FIGS. 17-18 when trip lever 86 is pivotally mounted to back plate 12 at one of the mounting holes 90.

Figure 11:
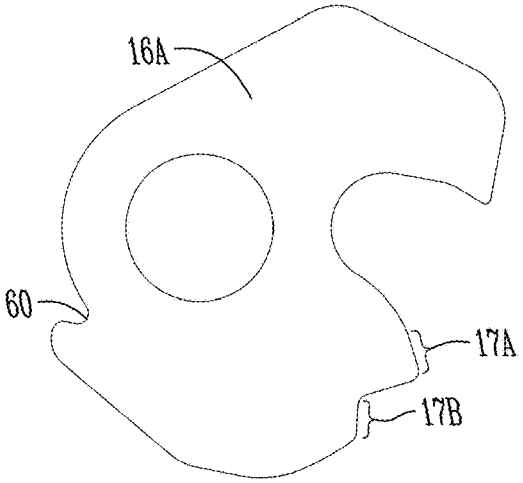
FIG. 11 is a plan view of a two-position rotor for use in the latch assembly of the present invention.
Figure 12:
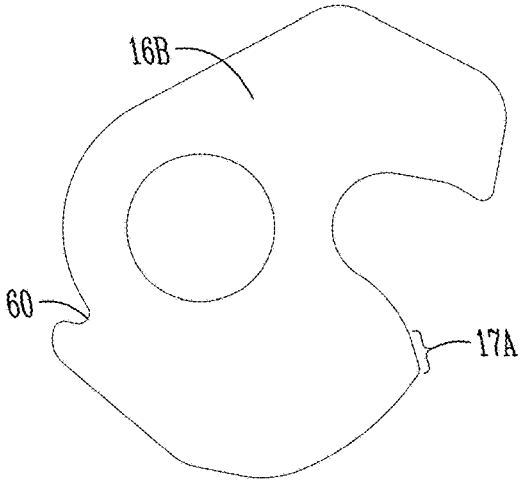
FIG. 12 is a plan view of a one-position rotor for use in the latch assembly of the present invention.
Figure 13:
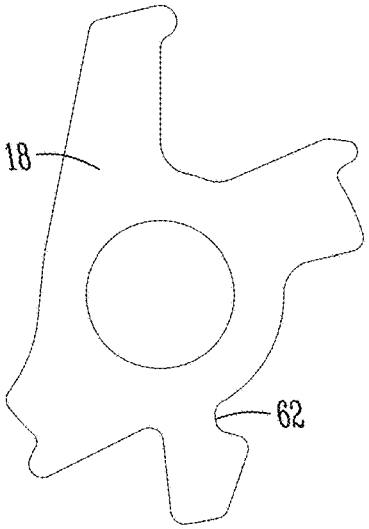
FIG. 13 is a plan view of the catch of the latch assembly.
Figure 14:
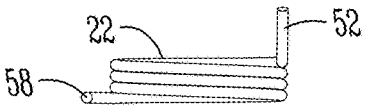
FIGS. 14-16 are views of one of the springs of the latch assembly, with the other spring being a mirror image.
Figure 15:
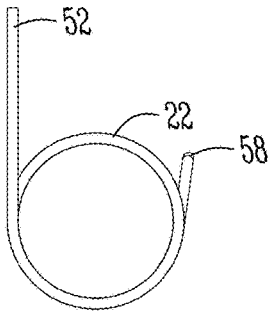
Figure 16:
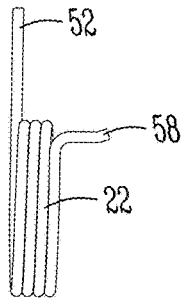

The latch assembly 10 of FIGS. 1 and 6 can be used on the left and right passenger doors of a vehicle, as well as on other vehicle compartment doors. For the primary vehicle doors which allow a driver and passenger to enter and exit the vehicle, a two-position rotor 16A is used, as shown in FIG. 11, as required by Government regulations. For other compartment doors, a single position rotor 16B can be used, as shown in FIG. 12. The two-position rotor 16A includes a first engagement point 17A (primary) and a second engagement point (secondary) 17B for the catch 18, whereas the single position rotor 16B only has the first engagement point 17A and not the second engagement point 17B.

The front plate 12 has opposite ends which are mirror images of one another relative to a line or plane passing through the center of the front plate. Similarly, the back plate 14 has opposite ends which are mirror images of one another relative to a line or plane passing through the center of the back plate. This symmetrical design of the front and back plates allows for increased versatility of the latch assembly 10.

Figure 17:
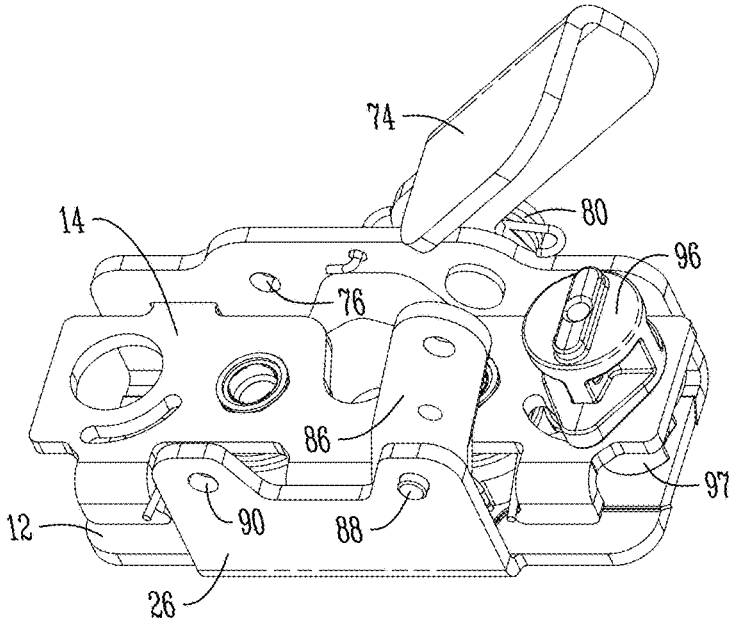
FIG. 17 is a perspective view of a latch assembly according to the present invention having dual trip levers and rotary actuation.
Figure 18:
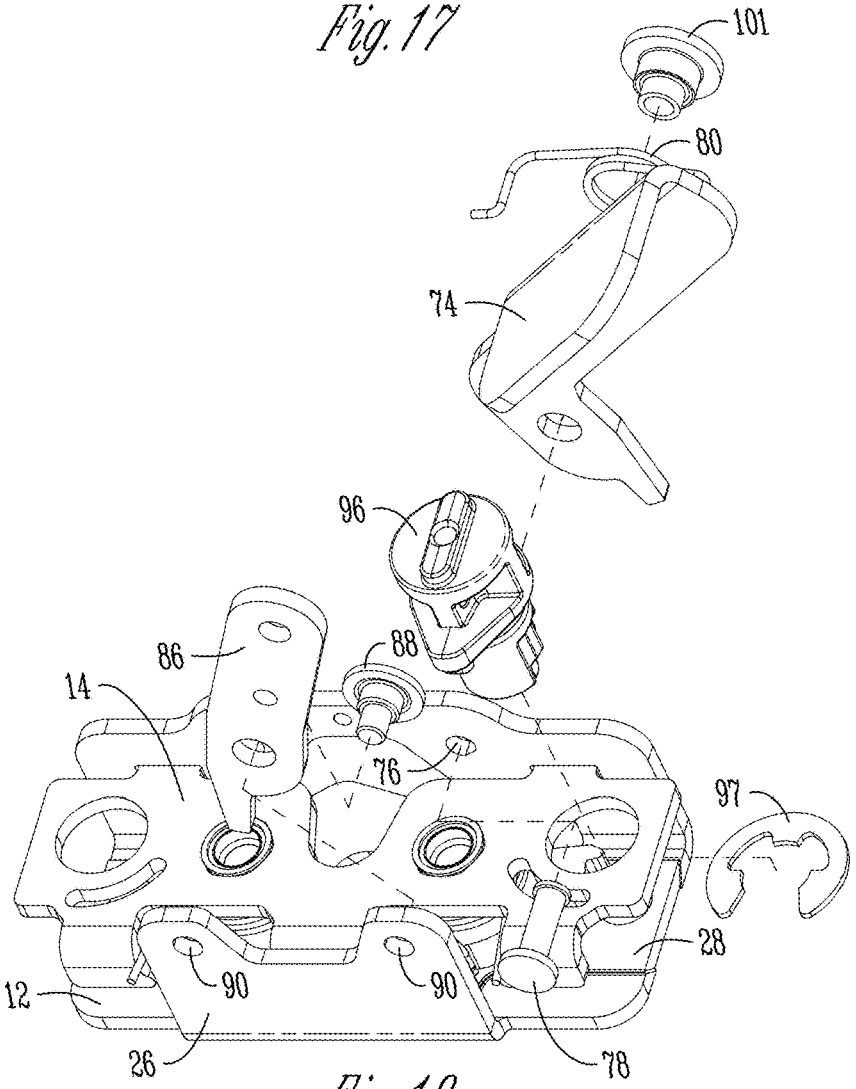
FIG. 18 is a partially exploded perspective view of the latch assembly of FIG. 27.

The latch assembly 10 is also designed for multiple options for a trip lever for releasing the rotor 16 and the catch 18 from the latched position to the unlatched position. For example, one or more trip levers 74, 86, 92 and 96 can be secured in the holes 68, 76, 90, 98, respectively in the latch plates. Since each plate 12, 14 is symmetrical, the trip levers can be mounted for both left-handed and right-handed latch assemblies, or for left and right hand trip levers. The trip levers are connected to manual door handles or power assist mechanisms, as is known in the art, so that actuation releases the catch 18, and thereby the rotor 16, from the latched position to the unlatched position. FIGS. 17 and 18 show various alternatives for these unlatching trip levers.

A multiple actuator option is shown in FIGS. 17-18, wherein the trip levers 74 and 86 are both utilized on the latch assembly 10, as well as a rotary actuator 96. In one actuation option shown in FIGS. 17 and 18, a trip lever 74 is mounted on the top flange 24 of the front plate 12. More particularly, the trip lever 74 is mounted in a hole 76 in top flange 24 via a rivet or pin 78. In one form a spring 80 is mounted on the rivet 78 and has a first end retained in the hole 82 in the top flange 24 and a second end engaging a hook on the lever 74. The spring 80 biases the trip lever 74 to a neutral position. The hole 82 is centered so as to provide indicia for aligning the striker. The trip lever 86 is retained by the rivet 88 extending through the hole 90 in the bottom flange 26 of the front plate 12. The rotary actuator 96 is retained by a clip 97 received in a groove in the actuator 96 beneath the back plate 14. While the actuator FIGS. 17 and 18 show the positions of the various actuators for a right-handed latch assembly, it is understood that these actuators can also be used in a similar manner for a left-handed latch assembly using corresponding holes in the plates, 12 and 14. The symmetrical or mirror image design of the plates 12 and 14 thus provide multiple mounting options for the various trip levers 74, 86, and 92, as well as the rotary actuator 96.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

We claim:

1. A latch assembly, comprising:

a C-shaped front plate with top and bottom flanges and a front face, and the flanges being centered relative to the front face;

a back plate mounted on the front plate the front plate by tabs on one of the plates extending through slots on the other of the plates and with a pair of axles mounted between;

a rotor and a catch pivotally mounted between the front and back plates for movement between latched and unlatched positions;

the top flange and front face having a cut-out to receive a striker;

the top flange having an opening into which the rotor and the catch extend in the unlatched position; and the top and bottom flanges each having multiple attachment points on opposite sides of a lateral center line for connecting a trip lever to actuate the catch.

2. The latch assembly of claim 1 wherein each flange is symmetrical and mirrored, with one of the attachment points located on each end.

3. The latch assembly of claim 1 further comprising first and second actuators connected to the top and bottom flanges, respectively.

4. The latch assembly of claim 1 further comprising an embossment on the front face supporting the rotor and the catch.

5. The latch assembly of claim 1 further comprising a second trip lever connected to the back plate.

6. The latch assembly of claim 1 wherein the front and rear plates each have mirror image opposite ends.

7. The latch assembly of claim 1 further comprising a pair of springs mounted on the axles to bias the rotor to the unlatched and the catch to the latched positions.

8. The latch assembly of claim 7 wherein the back plate includes symmetrical and mirrored tabs to retain ends of the springs.

9. The latch assembly of claim 1 wherein the back plate has a tab to limit rotation of the trip lever.

10. The latch of claim 1 wherein the slots are four sided to capture the tabs on four surfaces.

* * * * *